US005881885A

United States Patent [19]

Grimm

[11] Patent Number: 5,881,885

[45] Date of Patent: Mar. 16, 1999

[54] ARTICLE PACKAGING

[75] Inventor: Thomas H. Grimm, Menlo Park, Calif.

[73] Assignee: OddzOn Products, Inc., Campbell, Calif.

[21] Appl. No.: 807,622

[22] Filed: Feb. 27, 1997

[51] Int. Cl.[6] ..... B65D 85/00

[52] U.S. Cl. ..... 206/779; 206/315.9; 206/783

[58] Field of Search ..... 206/315.1, 315.9, 206/525, 583, 775, 776, 777, 779, 780, 783

[56] References Cited

U.S. PATENT DOCUMENTS

| | | | |
|---|---|---|---|
| 2,963,147 | 12/1960 | Stagner | 206/525 |
| 3,365,308 | 1/1968 | Janicke | 206/525 |
| 3,987,893 | 10/1976 | Hanson | 206/315.9 |
| 4,632,245 | 12/1986 | Lerner | 206/315.9 |
| 4,919,300 | 4/1990 | Anderson et al. | 206/583 |
| 5,232,095 | 8/1993 | Childers et al. | 206/583 |
| 5,379,892 | 1/1995 | Reams et al. | 206/315.9 |

*Primary Examiner*—Paul T. Sewell
*Assistant Examiner*—Luan K. Bui
*Attorney, Agent, or Firm*—Kolisch, Hartwell, Dickinson, McCormack & Heuser

[57] ABSTRACT

Capture/display packaging structure for a ball-like, or other hand-manipulable, article including an enclosure having spaced, opposite sides and an open exposure window intermediate those sides exposing a capture/display area for an article, and pinioning structure including at least one portion extending from adjacent one of such sides into the capture/display area adapted to pinion an article on display in the capture/display area.

1 Claim, 3 Drawing Sheets

ARTICLE PACKAGING

BACKGROUND AND SUMMARY OF THE INVENTION

This invention relates to article packaging, and more particularly, to display capture-packaging structure which affords touch access to a packaged article and permits some manipulation of the article, while at the same time essentially capturing the article in place within the article-storage area in the packaging enclosure.

While various kinds of articles, and particularly hand-manipulable articles, may be packaged in accordance with the present invention, a preferred embodiment is illustrated and described herein in conjunction with the packaging of a molded, generally football-shaped, game ball. Three different modifications, or embodiments, of such a ball are shown and described herein in the setting of being display-packaged in accordance with the invention.

The packaging of devices for sale, and particularly the packaging of toy-like devices, plays an important role in purchase appeal. Also playing an important role in such appeal, very often, is the ability of a prospective purchaser, at least in some fashion, to touch, handle and manipulate the article to some degree prior to buying it.

A general object of the present invention, accordingly, is to provide an innovative packaging structure for an article, such as a game ball, which both allows a certain amount of prepurchase touching, handling and manipulation of the ball, while at the same time effectively capturing it against removal and separation from an enclosure which forms part of the packaging structure.

Thus, the packaging structure of the invention operates to retain the packaged article in the appealing setting of its display package, while at the same time permitting a customer the opportunity for handling the article.

Various other features and advantages which are offered and attained by the invention will be come apparent as the description which follows is read in conjunction with the accompanying drawings.

DETAILED DESCRIPTION OF THE INVENTION

Figure 1:
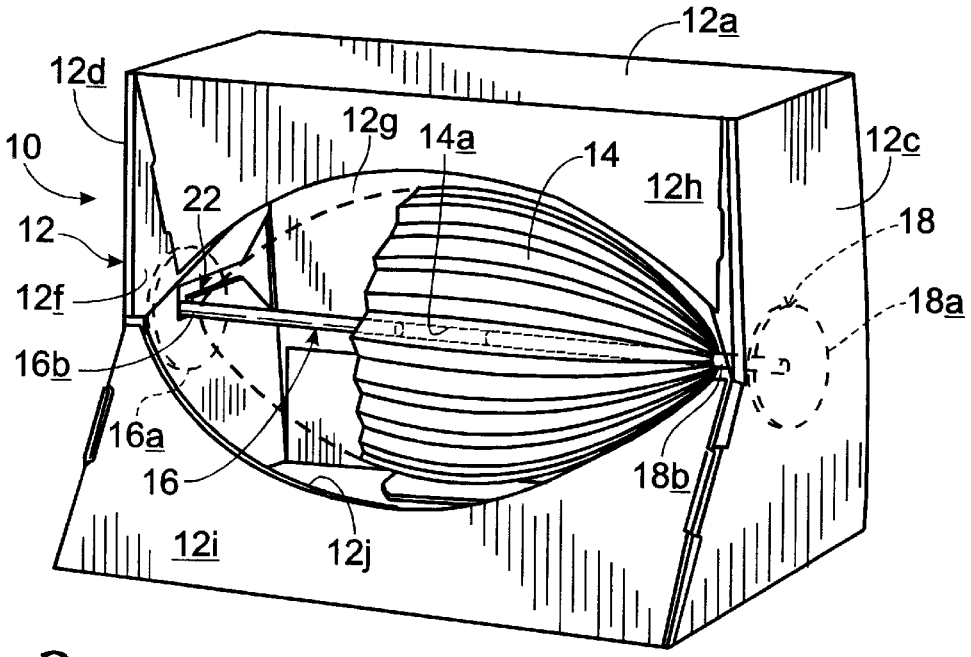
FIG. 1 is a perspective view illustrating a molded, generally football-shaped, game ball contained within capture/display packaging constructed in accordance with the present invention. The right-hand side of the ball, as illustrated in FIG. 1, is shown in solid lines and is fragmented, and the left side of the ball in this figure is shown in dashed lines in order to reveal certain otherwise hidden details of the packaging structure of the invention.
Figure 2:
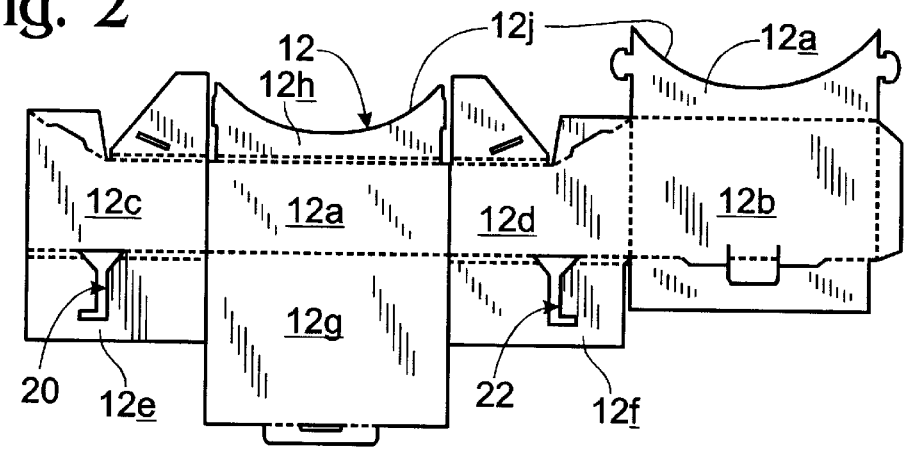
FIG. 2 is a reduced-scale view illustrating the printed-side surface (i.e., the customer-viewable outer surface) of a precut, foldable, cardboard blank which makes up the enclosure portion of the packaging structure illustrated in FIG. 1.
Figure 3:
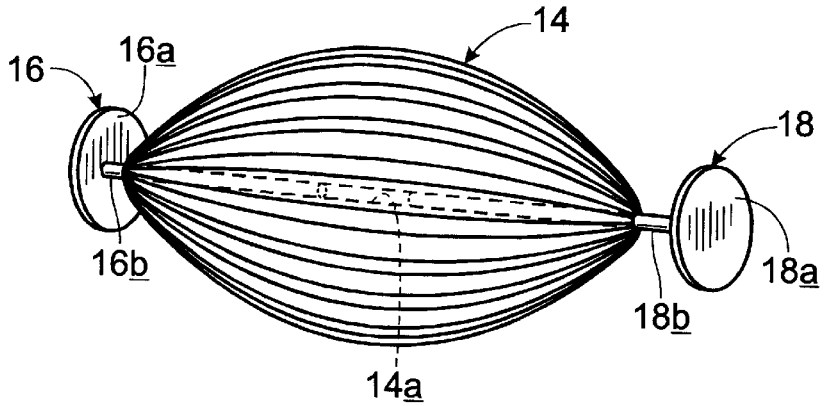
FIG. 3 is a side elevation of the ball which is shown packaged in FIG. 1 on about the same scale as that used in FIG. 1, and with the ball removed from the enclosure portion of the structure, and engaged, adjacent its opposite lateral ends, by wafer and post pinioning structures which also form part of the packaging structure of the present invention.

Turning attention now to the drawings, and referring first of all to FIGS. 1 and 2, indicated generally at 10 is display capture-packaging structure, including an enclosure 12, which is constructed in accordance the present invention. Enclosure 12 is formed of a precut single cardboard sheet pictured in developed, or laid-out-flat, condition in FIG. 2. The surface of this sheet which faces the viewer in FIG. 2 is appropriately printed for display purposes to be seen by a would-be customer when in the folded and displaying condition illustrated in FIG. 1.

In FIG. 1, structure 10 is shown holding, in a captured condition for display, a molded, generally football-shaped, game ball 14 which has been constructed in accordance, at least in part, with teachings set forth in two other co-pending U.S. patent applications of mine which are: U.S. Pat. No. 5,807,198, for TOSSABLE GAME-BALL DEVICE, issued Sept. 15, 1998 and U.S. Pat. No. 5,833,897, for METHOD OF FORMING TOSSABLE DEVICE INCLUDING GAME-BALL UNIT, issued Nov. 10, 1998. The entire disclosures of these two other patent applications are hereby incorporated herein by reference.

Ball 14, which is shown fragmentarily in FIG. 1, is supported, as will be described, in a captured but nevertheless touchable and somewhat manipulable condition within a capture/display area inside enclosure 12 on a pair of elongate wafer and post structures 16, 18 which are unitary elements preferably formed of a suitable, generally rigid plastic material. Structures 16, 18, also referred to herein both as article-pinioning structure and as article-pinioning spindle structure, include generally circular, planar wafers 16*a*, 18*b*, respectively, from one side of which project generally centrally located, elongate, slender posts 16*b*, 18*b*, respectively. These posts, also called spaced elements and portions, extend slidably into an elongate axial through-bore 14*a* in ball 14.

Returning focus now to the construction of enclosure 12, fold lines are indicated by dashed lines in the unfolded blank pictured in FIG. 2. Pointing out the major structural elements of the enclosure, the same includes a top panel 12*a*, a bottom panel 12*b* (see FIG. 2), a pair of spaced, opposite side or end panels 12*c*, 12*d*, a pair of slotted panels 12*e* (see FIG. 2), 12*f* joined (through double-fold lines) to side panels 12*c*, 12*d*, respectively, and including slots 20, 22, respectively, a back panel 12*g*, and upper and lower front panel flaps 12*h*, 12*i*, respectively, which, in the folded-together enclosure as pictured in FIG. 1, collectively form a front display panel structure including a generally football-silhouette-shaped, open exposure window 12*i* which provides a generally matching, unblocked reveal for a displayed ball, such as ball 14.

Slotted panels 12*e*, 12*f*, which laterally bracket the above-mentioned capture/display area, are referred to herein collectively both as spaced slot structures, and as facing, spaced side structure. Slots 20, 22 have generally triangular, enlarged ends near the fold lines between panels 12*c*, 12*e* and 12*d*, 12*f*, respectively, joining with elongate narrow L-shaped ends that, in the final assembled enclosure, extend forwardly toward window 12*i* (see particularly slot 22 as pictured in FIG. 1), and then slightly downwardly.

From the description which has just been given, and from a study of FIGS. 1 and 2 together, it should be evident how the blank pictured in FIG. 2 is and can be folded and assembled. In the particular enclosure structure illustrated, no gluing is necessary.

Figure 4:
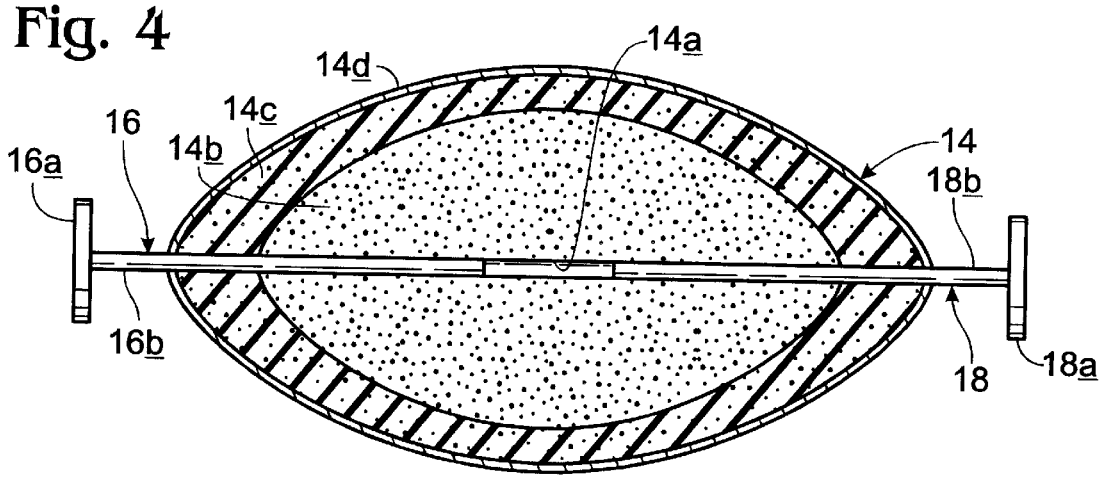
FIGS. 4 and 5 are similar views illustrating two different kinds of ball structures removed from the enclosure structure of the invention, and shown engaged with wafer and post pinioning structures like those just mentioned with respect to FIG. 3, and with the ball structures shown in longitudinal cross section. The ball shown in FIG. 4 has the same structure as the ball pictured in FIGS. 1 and 3.

FIG. 4 pictures ball 14 in longitudinal cross section removed from enclosure 12, but nonetheless receiving, in its elongate, central through-bore 14*a* posts 16*b*, 18*b* in wafer and post structures 16, 18, respectively. Ball 14, formed in accordance with teachings expressed in the above-referred-to, two, copending patent applications, includes a molded inner core 14*b* encased within a molded outer core 14*c* encased within a thin outer skin 14*d*. It will become apparent that, given the ball construction just described for ball 14, not only can the ball, in its finally packaged condition, rotate within enclosure 12*b*, but also it can slide back and forth somewhat on and along the post structures as permitted by lateral clearance in the capture/display area within enclosure 12.

Figure 5:
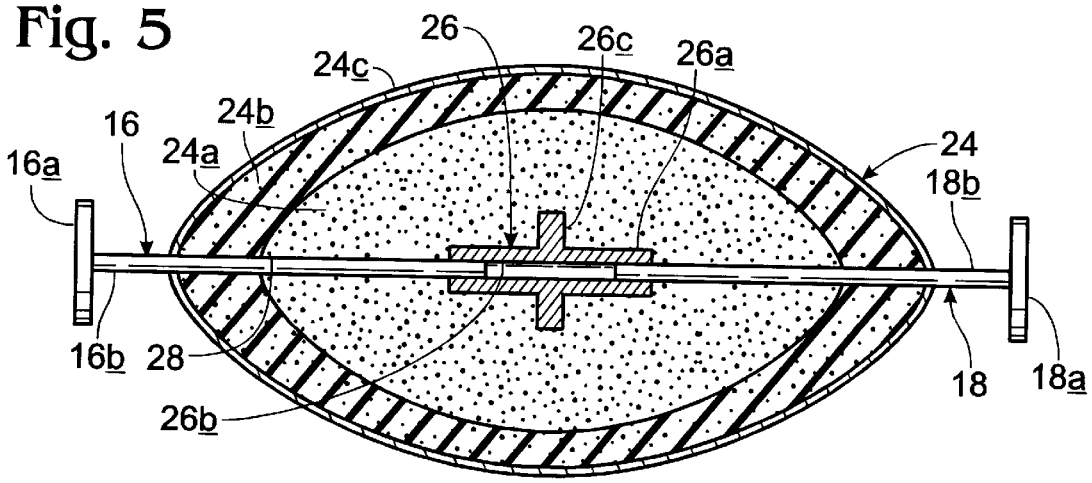

FIG. 5 illustrates a generally football-shaped, game ball 24 which is very much like ball 14 in construction, in that it includes a molded inner core 24*a*, a molded outer core 24*b* which encases the inner core, and a thin outer skin 24*c* which encases the outer core. Ball 24 differs from ball 14 by further including a central anchor element 26 embedded within inner core 24*a*, which element includes an elongate, tubular portion 26*a* having an elongate through-bore 26*b*, and a central, outwardly radiating, annular flange 26*c*. Bore 26*b* aligns itself with a through-bore 28 in the ball which extends to and opens at opposite ends thereof. In FIG. 5, wafer and post structures 16, 18 are shown in positions relative to ball 24 with the inner ends of posts 16*b*, 18*b* extending very slightly, and in a jam-fit condition, into the opposite ends of bore 26*b*. Under this mounting condition, ball 24 resists axial back and forth sliding on the posts.

Figure 6:
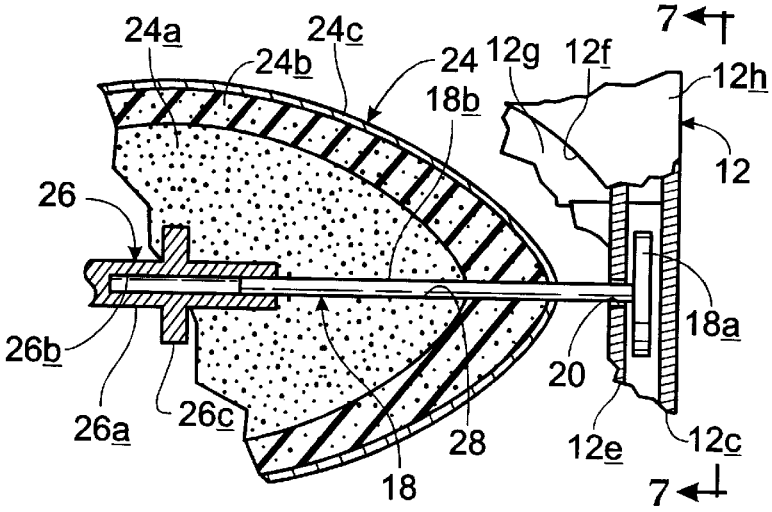
FIG. 6 shows, fragmentarily, details of packaging of the ball of FIG. 5 within and in relation to the packaging structure of FIG. 1.
Figure 7:
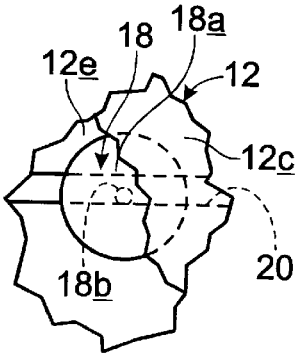
FIG. 7 is a fragmentary, and partially broken away, view taken generally along the line 7—7 in FIG. 6.

Except with respect to the different ways in which the inner ends of posts 16*b*, 18*b* engage the insides of balls 14, 24, in other respects, when the balls are received within enclosure 12, they are supported captured therein in like manners. FIG. 1 illustrates such display capturing for ball 14, and FIGS. 6 and 7 illustrate, in somewhat greater detail, display capturing of ball 24. Accordingly, and referring now to FIGS. 6 and 7, it will be seen that, with respect to wafer and post structure 18, wafer 18*a* lies in the narrow space which exists between end panel 12*c* and slotted panel 12*e*, wherein it is permitted very little back and forth (lateral) freedom of movement. Post 18*b*extends freely through slot into the capture/display area, and into the right end (in FIG. 6) of ball 24. A similar situation exists with respect to unshown wafer and post structure 16 in relation to the left end of ball 24 (as such would be seen if pictured in FIG. 6) and slot 22 in slotted panel 12*f*.

Figure 8:
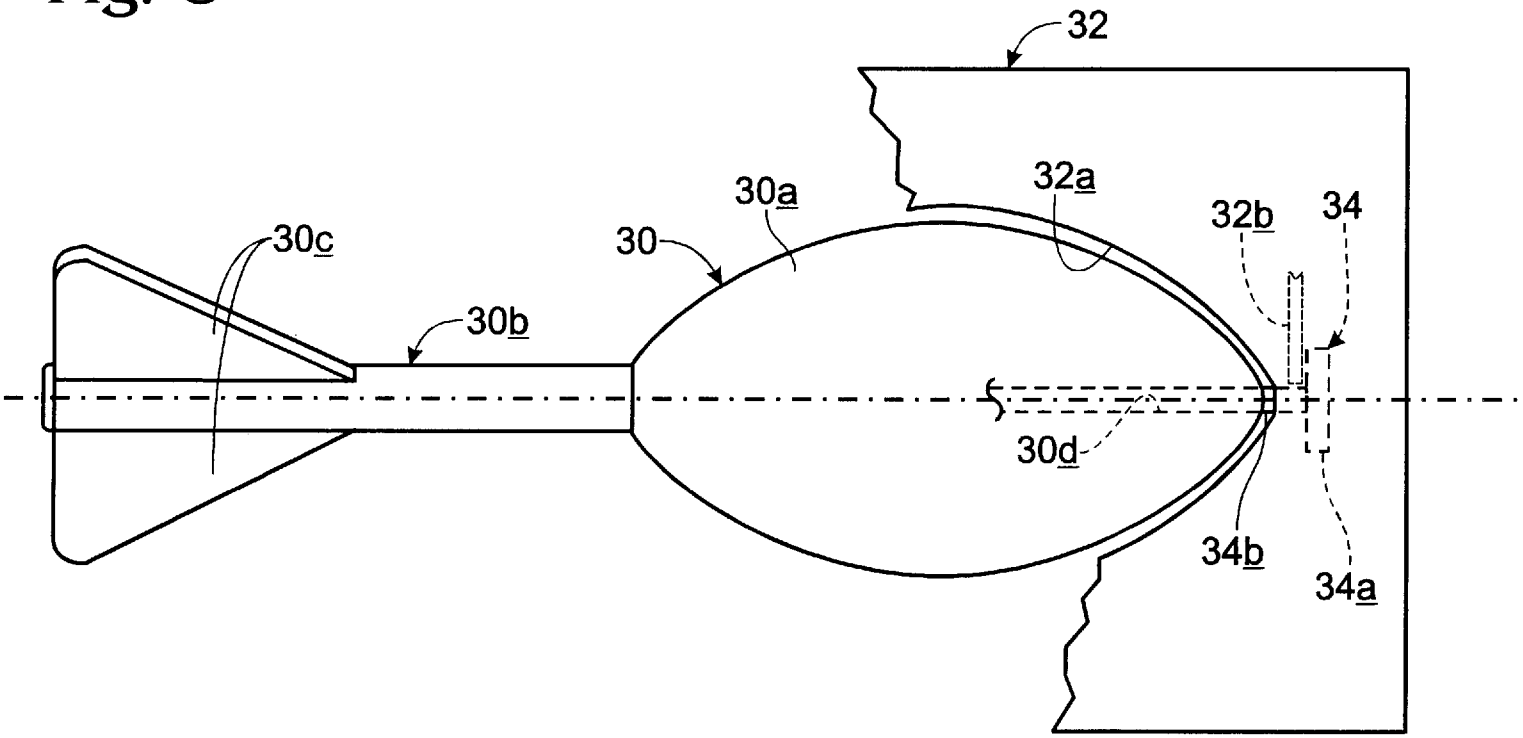
FIG. 8 is a fragmentary side elevation illustrating capture/display packaging for a third form of game ball of the type including an extending, finned tail.

FIG. 8 illustrates at 30 a third form of game ball held within the capture/display area provided in a packaging enclosure shown fragmentarily at 32. Ball includes a generally football-shaped ball unit 30*a*, a tail structure 30*b* including fins such as the two shown at 30*c*, and an elongate central through-bore 30*d* which extends axially inwardly into the right end of ball unit 30*a* in FIG. 8.

Details of enclosure 32 are not specifically laid out herein inasmuch as, given the disclosure above for enclosure 12, structural portions within enclosure 32 required to implement the invention should be apparent to those skilled in the art.

Indicated generally at 34 is wafer and post pinioning structure which is like the previously mentioned wafer and post pinioning structures, and which includes a wafer 34*a* suitably caught by the packaging enclosure, and a post 34*b* which extends through an opening in the enclosure into the capture/display area, and appropriately into through-bore 30*d*. Only a single wafer and post structure is employed in packaging for a game ball like ball 30.

Thus, there is provided by the present invention a unique packaging structure which enables the captured, touchable displaying of an article, such as the game balls described herein. It should be understood that while this invention has been described in conjunction with the display of three different kinds of game balls, other kinds of hand manipulable articles which are furnished with opposite, end-accessible through-bore structure, or the like, can be similarly displayed in a captured yet touchable condition. The pinioning structures may take different forms and, for example, may not necessarily require a circular, or even fill circular wafer portion. Accordingly, it is appreciated that variations and modifications may be made without departing from the spirit of the invention.

It is desired to secure and claim by Letters Patent:

1. Display capture-packaging structure for an article, the article including bore structure having open ends exposed adjacent opposite sides of the article, the display structure comprising an enclosure including spaced opposite sides and an open exposure window intermediate said sides exposing a capture and display area for an article, a pair of spaced slot structures, one located inwardly adjacent each said side and bracketing said capture and display area, a pair of wafer and post structures, each including a generally planar wafer, and an elongate post projecting generally centrally and normally from one face in the wafer toward a free end, said wafer and post structures, in an article-packaged condition, having their respective wafers positioned on the outer sides of said slot structures relative to said capture and display area, and their posts extending through the slot structures into such open ends of such bore structure in the article.

* * * * *